US005605060A

United States Patent [19]

Osborne

[11] Patent Number: 5,605,060

[45] **Date of Patent: *Feb. 25, 1997**

[54] CIRCULARLY KNIT BODYSUIT AND A BLANK AND METHOD FOR MAKING SAME

[75] Inventor: Harold G. Osborne, Boomer, N.C.

[73] Assignee: Alba-Waldensian, Inc., Valdese, N.C.

[ * ] Notice: The term of this patent shall not extend beyond the expiration date of Pat. No. 5,479,791.

[21] Appl. No.: 479,177

[22] Filed: Jun. 7, 1995

Related U.S. Application Data

[63] Continuation-in-part of Ser. No. 237,114, May 3, 1994, Pat. No. 5,479,791, and a continuation-in-part of Ser. No. 420, 247, Apr. 11, 1995.

[51] Int. Cl.[6] ..... A41C 3/00; D04B 1/24

[52] U.S. Cl. ..... 66/171; 450/92; 450/70; 66/169 R; 66/172 R; 66/172 E; 2/69

[58] Field of Search ..... 66/171, 172, 176, 66/153; 450/70, 92; 2/69

[56] References Cited

U.S. PATENT DOCUMENTS

| | | | |
|---|---|---|---|
| 993,112 | 5/1911 | Scott | 66/199 |
| 993,799 | 5/1911 | Scott | 66/199 |
| 1,775,033 | 9/1930 | Wilkinson | 66/153 X |
| 2,174,948 | 10/1939 | Raven et al. | 66/153 |
| 2,293,639 | 8/1942 | Coleman | 66/188 |
| 3,224,231 | 12/1965 | Matz | 66/171 |
| 3,376,717 | 4/1968 | Scheller et al. | 66/199 |
| 3,421,513 | 1/1969 | Landau | 128/443 |
| 3,425,246 | 2/1969 | Knohl | 66/176 X |
| 3,537,279 | 11/1970 | Epley | 66/176 |
| 3,999,406 | 12/1976 | Boeckle et al. | 66/177 |
| 4,341,219 | 7/1982 | Kuznetz | 128/498 |
| 4,390,999 | 7/1983 | Lawson et al. | 2/409 |
| 4,531,525 | 7/1985 | Richards | 128/489 |
| 4,548,057 | 10/1985 | Essig | 66/172 R |
| 4,570,461 | 2/1986 | Sawazaki | 66/198 X |
| 4,624,115 | 11/1986 | Safrit et al. | 66/172 R |
| 4,682,479 | 7/1987 | Pernick | 66/176 |
| 5,081,854 | 1/1992 | Lonati | 66/176 |
| 5,479,791 | 1/1995 | Osborne | 66/171 |

FOREIGN PATENT DOCUMENTS

| | | |
|---|---|---|
| 387766 | 9/1990 | European Pat. Off. . |
| 2220150 | 9/1974 | France . |

*Primary Examiner*—John J. Calvert
*Attorney, Agent, or Firm*—Bell, Seltzer, Park & Gibson, P.A.

[57] ABSTRACT

This invention discloses a shirt, bodysuit and teddy having built-in breast cups and/or selected areas of varying cross-stretch in order to provide compressive support for a wearer's body, and methods and blanks for manufacturing such shirts, bodysuits and teddies. In particular, circular knitting operations are used to produce garments having areas of compressive support in the middle torso region, and a greater amount of cross-stretch in the region corresponding to a wearer's breast area. In addition, the garments can include integrally-knit breast cups and a gathered panel located between the breast cups. Shirts made according to the present invention can include a turned welt about their lower or shirttail ends, in order to eliminate the need for hemming the lower shirt portion. Blanks and methods for making the garments are also disclosed, which require only a minimal number of manufacturing operations to be converted into completed garments.

47 Claims, 2 Drawing Sheets

CIRCULARLY KNIT BODYSUIT AND A BLANK AND METHOD FOR MAKING SAME

RELATED APPLICATIONS

This application is a Continuation-in-Part of U.S. patent applications Ser. Nos. 08/237,114, filed May 3, 1994 for "Brassiere Blank, Brassiere and Methods of Making Same", now U.S. Pat. No. 5,479,791, and 08/420,247, filed Apr. 11, 1995, for "Shirt Blank, Shirt and Methods of Making Same."

BACKGROUND OF THE INVENTION (1) Field of the Invention

The present invention relates to a shirt, bodysuit and teddy, and the blank and methods for making the same. More particularly, this invention relates to the production of a shirt or bodysuit blank on a circular knitting machine, and the production of a shirt or bodysuit from the blank having seams only at the shoulders and crotch, where applicable. Even more specifically, the invention relates to the production of a shirt, bodysuit or teddy having integrally knit compression areas to shape a wearer's body, and the blank and methods for making the same.

(2) Description of the Prior Art

Brassieres having fabric areas to define breast cups have been produced by full fashioned and reciprocating knitting machines, but blank and brassiere production tends to be slow and inefficient unless circular knitting is used. One circular knitting process is disclosed in U.S. Pat. No. 4,531,525 to Richards, wherein a brassiere blank is made on a circular knitting machine. The process includes producing a cylindrical tubular blank having a torso portion with a pair of breast cups, straps knit integrally with the torso portion, and turned welt portions at each end of the cylindrical blank. The tubular blank is slit on one side and laid flat for cutting neck and arm openings and seaming at each side to form the brassiere.

Attempts have been made on certain nether-type knitted undergarments to provide variations in the compression provided by the undergarment in areas corresponding to particular areas of a wearer's body. For example, U.S. Pat. No. 4,390,999 to Lawson et al. describes the provision of a fabric portion having a medium amount of compressive force between a highly compressive upper waist or leg portion and a low compression body portion, in order to ease the transition from the highly compressive portion to the low compression portion and reduce the resultant body bulge which can be caused by that transition. The areas providing the medium amount of compressive force are shaped and located so that they extend circumferentially about the waist or leg of the wearer in the manner of a band, and they are formed by changing the yarn used to knit various courses.

Similarly, U.S. Pat. No. 3,413,824 to Kuney discloses knitted undergarments which include form-fitting pockets in order that they can accentuate specific portions of the body. The garments are knitted using a constant stitch structure, with the stitch length being varied in selected areas to form spaced concave areas which are designed to correspond to specific regions of the wearer's body. In the illustrated embodiments, the nether garments include loosely knit regions corresponding to the buttock cheeks and a tightly knit seam piece extending vertically between the loosely knit regions. Though mentioning broadly that the structure could be used with brassieres, the Kuney patent does not disclose how the structure can be incorporated into such a brassiere.

U.S. Pat. No. 3,425,246 to Knohl discloses a knitted brassiere having extra courses of elastic yarn knitted into the breast cups to shape the cups by providing fullness therein.

U.S. Pat. No. 5,081,854 to Lonati describes a one-piece body garment which is knit on a circular knitting machine. An elastic thread or threads can be inserted in the waistband portion to form an elastic band at the waistband. These garments can tend to lack sufficient breast support for women, and fail to provide means for enhancing the appearance of the wearer's body.

Blanks for the production of knitted shirts are conventionally knit in flat or tubular form. The blanks are then cut to form arm openings and a neck opening, seamed along the side if necessary, and the bottom of the shirt is hemmed. To complete the shirt, a separately manufactured neckband is then sewn to a neck opening of the T-shirt, usually with a double row of stitching, and the arm openings are then finished, usually either by hemming or attaching banding, to thereby form a finished shirt. Because all of these seaming processes require the input of labor, each seaming step increases the manufacturing costs of the shirt.

Thus, a need exists for a method of making shirts which requires a minimal amount of seaming to provide an efficiently and rapidly producible garment, and blanks and shirts requiring only a minimal number of seams. In addition, a need exists for a shirt, bodysuit, and teddy construction which can provide shaping support for a wearer's body and can accommodate the curves of various wearer's bodies, and which can be rapidly and easily produced using only a minimal number of manufacturing steps and labor input.

SUMMARY OF THE INVENTION

With the foregoing in mind, it is therefore an object of this invention to provide a method of making a circular knit, tubular blank from which a shirt may be made with only a minimal number of seams, and which can be made to provide shaping support for the wearer's body.

It is a further object of this invention to provide a method of making a circular knit, tubular blank from which a teddy or bodysuit can be made, and which requires only a minimal number of manufacturing steps for the conversion of the blank into the completed garment.

It is also an object of the invention to provide a circular knit blank for the manufacture of a shirt which provides shaping support for a wearer.

It is an additional object of the invention to provide a circular knit blank for the manufacture of a bodysuit or teddy which provides shaping support for a wearer.

It is a further object of the invention to provide methods of making a shirt, bodysuit and teddy having knit-in shaping support using only a minimal number of manufacturing steps.

An even further object of the invention is the provision of a shirt, bodysuit and teddy having knit-in shaping support and only a minimal number of seams.

In accordance with the present invention there is described a method of manufacturing a circular knit blank for making a shirt which includes knitting a series of courses defining a non-raveling edge. In a preferred form of the invention, this non-raveling edge is provided in the form of a cylindrical tubular torso encircling portion in the form of a turned welt, as this enables the production of a shirt without the conventionally required hemming of the lower portion.

A middle torso portion for covering the areas about the waist of a wearer's body is then knit to the torso encircling portion as a tubular fabric portion. This middle torso portion is knit so as to be compressible in order that it can provide compressive support to the underlying portions of a wearer's body.

An upper torso portion comprising a series of courses defining a tubular fabric portion is then knit to the middle torso portion. The upper torso portion is knit to have greater cross-stretch (i.e. coursewise stretch) than the middle torso portion, preferably by lengthening the stitches making up the upper torso portion. In this way, when the blank is converted into a finished shirt, the upper torso portion does not compress the wearer's breasts in the manner that the rib and stomach areas covered by the middle torso portion are compressed.

The upper torso portion also desirably includes a pair of breast cups integrally knit into a front portion thereof, the cups being defined by two areas in which the fabric is in simple knit courses with these areas being separated one from another. In a preferred embodiment of this invention, the breast cups are separated one from the other by a central area of gathered panels in which succeeding courses vary between simple knit and welt knit courses. In the embodiment of the shirt blank including breast cups, the rear portion of the blank desirably maintains a constant knit structure throughout the middle and upper torso portions, though the stitch lengths can be lengthened at the upper torso portion in the manner discussed above.

A shoulder portion is then knit in tubular form to the upper torso portion. The shoulder portion includes elongated areas in which the courses are simple knit, with the areas being divided by elongated panel areas in which successive courses are also simple knit. Lastly, the circularly knit tubular blank is completed by knitting several courses forming a non-raveling edge.

The shirt of the present invention is made from the circular knit tubular blank by cutting and removing selected portions of the blank to form a neck opening and arm openings. Front and rear portions of the shoulder portions are sewn together, and banding and the like can be added to finish the arm and neck openings, or the openings can be hemmed or selvaged. There is thus provided a shirt made from a blank of knit construction which can be shaped to the contours of a wearer's body, and requires only a minimal number of steps for its production.

A blank for a bodysuit or teddy is produced in a similar manner to that of the shirt. A series of courses defining a non-raveling edge is knit in tubular form. A lower torso portion is knit to the non-raveling edge, and desirably includes a region proximate the non-raveling edge which has a modified knit configuration for forming the crotch portion of the garment. For example, the crotch forming portion of the blank can be knit to form a terry pile surface in a region which will correspond to the wearer facing portion of the crotch of the garment.

A middle torso portion is knit to the lower torso portion, and is knit so that a garment made therefrom will provide compressive support to underlying regions of a wearer's body when the garment is worn.

An upper torso portion is then integrally knit to the middle torso portion. The upper torso portion is knit to have greater cross-stretch than the middle torso portion, preferably by lengthening the stitches used to form the upper torso portion. In this way, when the blank is converted into a finished bodysuit or teddy the upper torso portion does not compress the wearer's breasts in the manner that the rib and stomach areas covered by the middle torso portion are compressed.

It is noted that the lower torso portion can be compressive in the same manner as the middle torso portion, or it can be less compressive in the manner of the upper torso portion.

The upper torso portion also desirably includes a pair of breast cups integrally knit into a front portion thereof, the cups being defined by two areas in which the fabric is in simple knit courses with these areas being separated one from another. In a preferred embodiment of this invention, the breast cups are separated one from the other by a central area of gathered panels in which succeeding courses vary between simple knit and welt knit courses. In the embodiment of the bodysuit and teddy blank including breast cups, the rear portion of the blank desirably maintains a constant knit structure throughout the middle and upper torso portions, though the stitch lengths can be lengthened at the upper torso portion in the manner discussed above.

A shoulder portion is then knit in tubular form to the upper torso portion. The shoulder portion includes elongated areas in which the courses are simple knit, with the areas being divided by elongated panel areas in which successive courses are also simple knit. Lastly, the circularly knit tubular blank is completed by knitting several courses forming a non-raveling edge.

The bodysuit and teddy of the present invention are made from the circularly knit tubular blank by cutting and removing selected portions of the blank to form a neck opening, arm openings, and leg openings and a crotch portion therebetween. Front and rear portions of the shoulder portions are sewn together, and banding and the like can be added to finish the arm and neck openings, or the openings can be hemmed or selvaged. Front and rear blank portions are then joined by sewing or the like to form a bodysuit. Alternatively, snaps, hook and loop fasteners, or other types of releasable fasteners may be attached to front and rear blank portions at the crotch region, to form a teddy.

For purposes of this invention, a bodysuit is defined as a garment having upper and lower torso covering portions with a crotch portion which extends between a wearer's legs, with front and rear portions of the crotch portion being sewn or otherwise permanently attached together. In contrast, a teddy is defined as a garment like that of the bodysuit, but in which the front and rear portions of the crotch portion are joined by way of releasable fasteners, whereby the garment can be opened at the crotch. For purposes of the claims, a garment adapted to cover substantially the entire torso of a wearer is meant to encompass both bodysuits and teddies. However, it is noted that the specific garments disclosed can be used as under or outer garments, and may be used by men, women and children alike. The crotch portion can be specially configured to accommodate either male or female anatomy, at the preference of the manufacturer.

There is thus provided a bodysuit and teddy made from a blank of knit construction which can be shaped to the contours of a wearer's body, have selected regions of compressive body control, and require only a minimal number of steps for their production.

Other objects, features and advantages of the present invention will become apparent from the following detailed description when taken in conjunction with the accompanying drawings.

DESCRIPTION OF THE PREFERRED EMBODIMENTS

Figure 1:
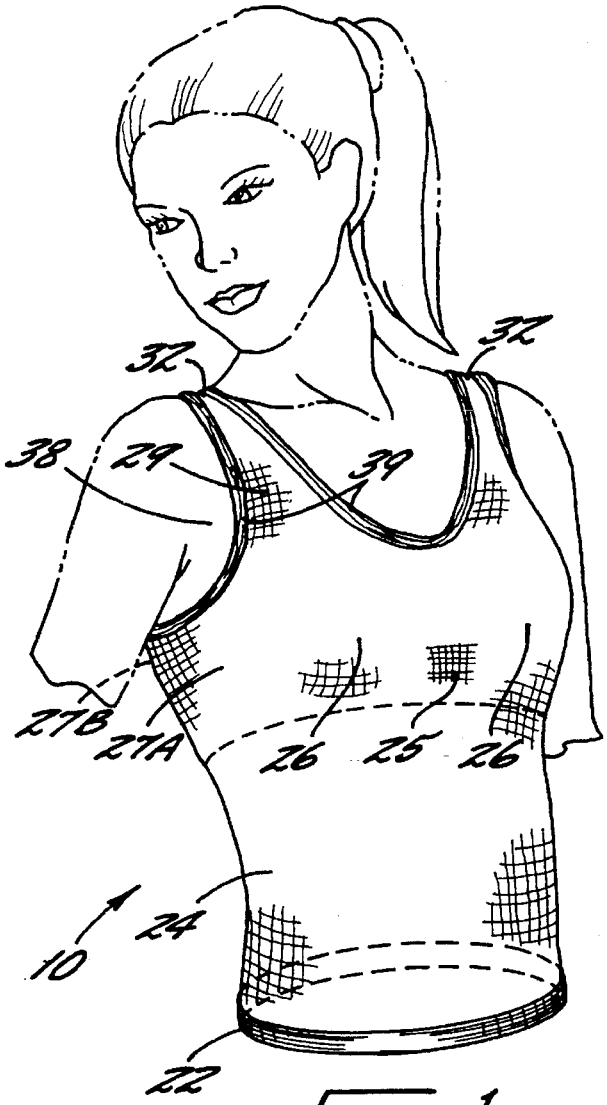
FIG. 1 is a perspective view illustrating an embodiment of a shirt according to the present invention, the shirt being made from the blank shown in FIGS. 2*a* and 2*b* show enlarged views of the knit structures shown in FIG.1

Referring now to the drawings, FIG. 1 shows a preferred embodiment of the finished shirt of the present invention referenced generally at 10. The shirt 10 includes a non-raveling edge portion which is preferably in the form of a cylindrical tubular torso encircling portion 22, e.g. a turned welt. A middle torso portion 24 in the form of a fabric tube is knitted to the torso encircling portion 22 and is designed to cover the area of a wearer about the lower ribs and the waist, and below the waist as desired. It is particularly preferred that the middle torso portion be of sufficient length to enable a wearer to tuck the lower end of the shirt into his or her pants, though other lengths are within the scope of the invention, such as a length which enables the shirt lower edge to fall just above a wearer's waist. The middle torso portion is knit so that is can provide compressive support to the underlying portions of a wearer's body.

An upper torso portion 27 comprising a series of courses defining a tubular fabric portion is knit to the middle torso portion 24 and includes a front upper torso portion 27*a* and a rear upper torso portion 27*b*. The front upper torso portion 27*a*, in a preferred embodiment of the invention, includes a pair of integrally knit breast cups 26 defined by areas in which the courses are simple knit and have succeeding areas of courses varying between simple knit and welt knit courses. The courses defining the front torso portion 27*a* differentially shape the breast cups 26. The upper torso portion 27 includes a rear upper torso portion 27*b* above the middle torso portion 24 in which the fabric is preferably in simple knit courses.

Figure 3:
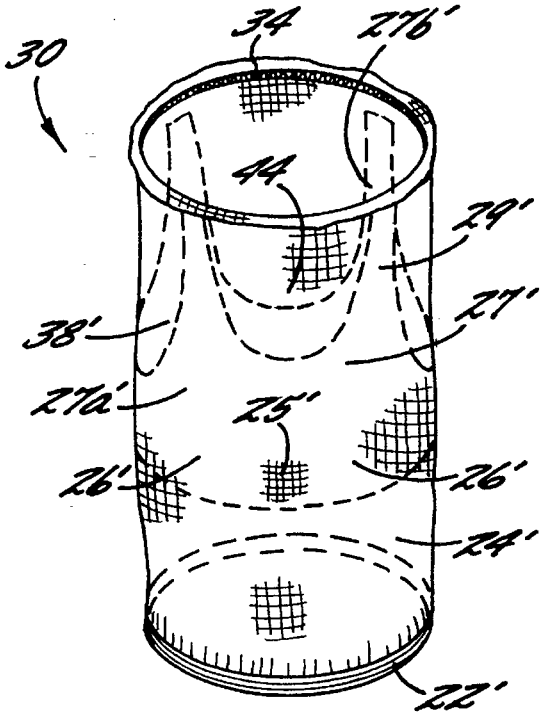
FIG. 3 is a perspective view of a blank for making the shirt of FIG. 1.

In a preferred embodiment of this invention, the breast cups 26 are defined by areas in which the courses are simple knit with the breast cup areas 26 being separated by a center gathered panel area 25, shown in FIGS. 1 and 3, in which the courses vary between simple and welt knit courses. The gathered portion 25 is made by pulling the cams of the knitting machine away from the butts, allowing the shorter butt needles to pass through underneath the cams to hold the stitch for a predetermined number of courses, say 3 to 20 and preferably 10 to 12. The needles are then raised to clear the stitch to form a pleat, and the process is repeated until the gather is formed. Needles for tuck or pleat can be made without using cams by the selection of the needles to hold the stitch by knitting at welt height. The cams are then returned to the cylinder so that the short butt needles will rise.

Figure 2B:
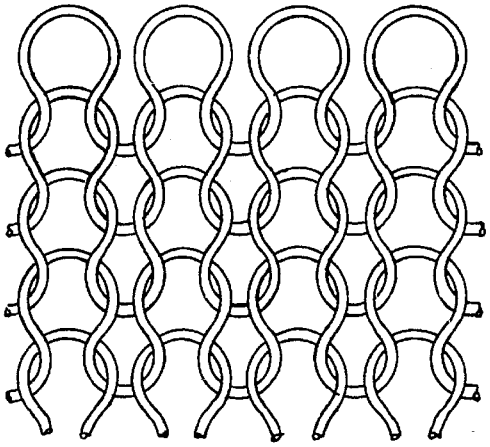
Figure 2A:
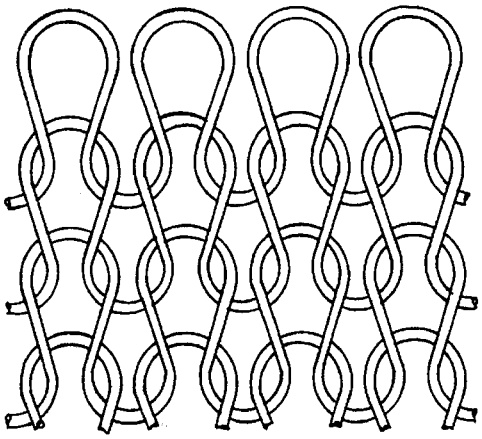

The upper torso portion 27 also desirably is knit to have greater cross-stretch than the middle torso portion 24, in order that the breast region of the wearer is not undesirably compressed. This is preferably achieved by forming the upper torso portion 27 from longer stitches than those used to form the middle torso portion 24. In this way, the compression provided by the garment to the underlying body portions of a wearer is reduced in the area of the breasts of the wearer, thereby preventing the breasts from experiencing the discomfort that compression would inflict on these areas. Further, the stitches are preferably lengthened starting immediately below the breast region of the wearer, enabling the compressive middle torso portion to assist in supporting the breasts, in addition to providing a more slimming appearance to the underlying regions. The differences in stitch lengths are shown in FIGS. 2*a* and 2*b*, which show the knitted structure of the upper torso 27 and the middle torso portion 24, respectively. Though the knitted stitches depicted are in simple form, it is noted that different types of knit stitches could be used to perform the invention.

A shoulder portion 29 is then knit to the upper torso portion in the form of a tubular fabric portion. The fabric forming the shoulder portion 29 is preferably knit in simple knit courses with patterns. Front portions of the shoulder portion are sewn to rear portions of the shoulder portion at seams 32 to form shoulder straps, thereby forming a completed shirt.

Turning now to FIG. 3, there is shown a shirt blank 30, made on a high speed circular knitting machine, from which the shirt 10 is produced. The blank 30 is in tubular form, and is knit to include portions which correspond to the portions of the shirt described in FIG. 1. The reference characters corresponding to those used with reference to FIG. 1 will be applied in FIG. 3, with the addition of prime notation.

The torso encircling portion 22' in the blank 30 is preferably formed as a cylindrical tubular fabric portion in the form of a turned welt. A middle torso portion 24' is knit to the torso encircling portion 22' as a tubular fabric portion, and is knit so as that it provides compressive support on underlying portions of a wearer's body when it is converted into a shirt.

An upper torso portion 27' is then knit to the middle torso portion 24'. The upper torso portion 27' is knit in tubular form to include a front upper torso portion 27*a'* and a rear upper torso portion 27*b'*. The upper torso portion 27' is knit to have a greater degree of cross-stretch than the middle torso portion 24', preferably by using longer stitches to form the upper torso portion than those which are used to form the middle torso portion.

In a preferred embodiment of the invention, the blank includes a pair of integrally knit breast cups 26' on the front upper torso portion 27*a'* thereof. The breast cups 26' are defined by areas in which courses are simple knit, with the areas being spaced apart from one another. In a particularly preferred embodiment of the invention, the breast cups 26' are separated one from the other by areas of gathered panels 25' in which succeeding courses vary between simple knit and welt knit courses, the knitting of courses defining the front upper torso portion differentially shaping the breast cups with respect to the gathered panels. As will be understood, the degree of shaping will vary, and may be taken into account in accomplishing sizing of the shirt.

A shoulder portion 29' is knit to the upper torso portion 27', and preferably includes elongated areas in which the courses are simple knit, with the areas being divided by an elongate panel area. In this way, a cutting pattern 33 can be formed in the knit structure of the blank itself, thereby enabling a worker to cut portions of the blank to form arm openings and define a neck section, without the need for additional patterning or marking. In addition, the yarn feeds can be manipulated in order that less yarn is fed to the portions of the blank 30 which are to be cut and removed, thereby reducing the amount of material waste produced as a result of shirt formation.

The blank is finished by knitting a series of courses in the form of a non-raveling edge 34. The non-raveling edge 34 serves to prevent raveling of the blank 30 during the time between when the blank is produced and when it is converted into a completed shirt 10.

The various portions of the circular knit tubular shirt blank 30 are integrally knit together and have stitch constructions as described hereinabove. Thus, the method of manufacturing the blank will become more clearly understandable and may be characterized as knitting a series of courses defining a first cylindrical tubular portion in the form of a turned welt 22', and then knitting to the turned welt portion a series of courses defining a middle torso portion 24'. The middle torso portion 24' is knit so as to have limited cross-stretch, in order that it will provide compressive support to the portions of a wearer's body located underneath the middle torso portion when the blank is converted into a shirt.

An upper torso portion 27' formed by a series of courses defining a tubular fabric portion is then knit to the middle torso portion 24'. The upper torso portion 27' is knit to have a greater degree of cross-stretch than that of the middle torso portion 24', preferably by knitting the upper torso portion from longer knitted stitches or loops than the middle torso portion. In preferred embodiments of the invention, the upper torso portion can be knit to include first and second breast cups 26' in which spaced apart portions of the upper torso portion are simple knit. In a particularly preferred embodiment, the breast cups 26' are spaced apart by gathered panels 25', as discussed above.

A shoulder portion 29' is then knit to the upper torso portion 27', and preferably is knit to include a plurality of elongated areas in which the courses are simple knit, with these elongated areas being separated from each other by elongated panel areas. To complete the blank, a plurality of courses defining a non-raveling edge 34 are then knit to the shoulder portion 29'.

The manufacture of the shirt 10 is performed as follows, with particular reference being made to FIG. 3. The tubular blank 30 is cut along the cutting pattern, which is indicated by dotted lines 33 shown in FIG. 3. The cut portions are removed from the blank to thereby define arm openings 38 and a neck opening 44. The thus cut blank 30, as shown in FIG. 3, is then joined at seams 32 to connect front and rear portions of the shoulder portion 29 at opposite sides of the neck opening 44, to thereby form a completed shirt.

Banding and the like 39 may be added at the arm openings and neck opening to finish off the shirt, or raw arm opening and neck opening edges can be hemmed or selvaged to form a finished shirt.

Simple knit stitches are used to distinguish those stitch constructions possible on a circular knitting machine and in which yarn is taken into a needle during each rotation of the cylinder, such as plain, purl, tuck and combinations thereof. References to welt knit are intended to encompass miss-stitch or float stitch constructions in which loops in certain courses are held without additional yarns being taken and then knit into subsequent courses, thereby gathering the courses together and providing the characteristic turned welt or panel effect referred to above.

Figure 4:
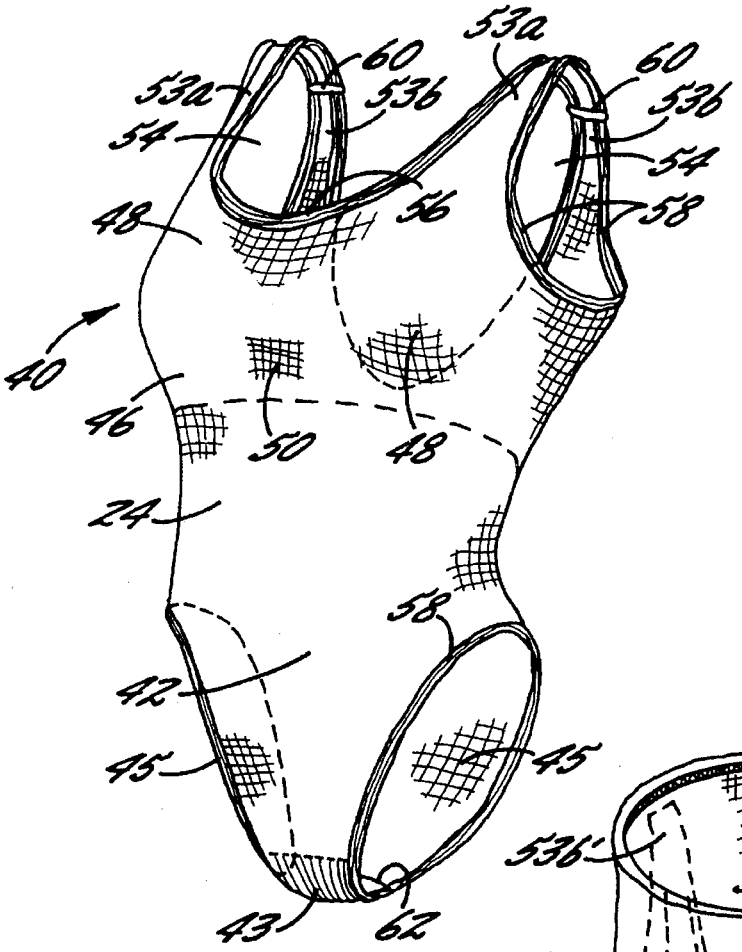
FIG. 4 is a perspective view of a bodysuit or teddy according to the present invention, the bodysuit or teddy being made from the blank shown in FIG. 5.
Figure 5:
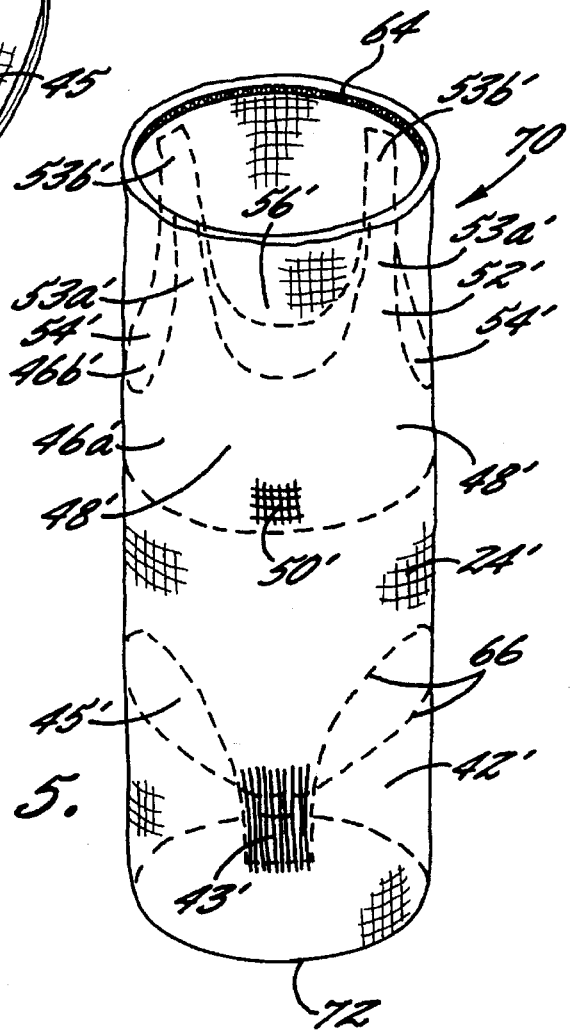
FIG. 5 is a perspective view of a circular knit blank in accordance with the present invention and from which the bodysuit or teddy of FIG. 4 is manufactured.

FIGS. 4 and 5 illustrate another embodiment of the invention, namely a bodysuit or teddy 40 and a blank for making the bodysuit or teddy. Again, like numbers are used to represent like elements on the garment and the blank, with the common elements being primed on the blank.

The blank 130 is made similarly to the blank 30 in FIG. 3, but is extended beyond the turned welt portion 22' of that blank to form a lower torso portion 42'. The blank 70 includes a series of courses forming a non-raveling edge 72 about a lower portion of the blank. A lower torso portion 42' is knit in the form of a tubular fabric portion to the non-raveling edge 72. This lower torso portion 42' preferably includes a crotch region 43' which has a modified stitch construction of the type conventionally used to form a panty crotch portions. Particularly preferred is a knit construction which includes a terry surface which is adapted to extend along a wearer-contacting surface of the crotch portion of a garment made from the blank 70.

A middle torso portion 24' is integrally knit to the lower torso portion 42' in the form of a tubular fabric portion. This middle torso portion a 24' is knit to have limited cross-stretch which enables the portion of a garment made from the blank 70 which corresponds to the middle torso portion to compressively support a portion of a wearer's body which it covers.

An upper torso portion 46' is knit in tubular form integrally with the middle torso portion 24', and includes for purposes of describing location a front upper torso portion **46*a*' and a rear upper torso portion 46*b*'. It is noted, however, that these portions form a part of the integrally knit tubular upper torso portion 46 rather than comprising separate elements. The upper torso portion 46' comprises a series of courses defining a pair of breast cups 48' on the front upper torso portion 46*a*' defined by areas in which the courses are simple knit and having succeeding courses varying between simple knit and welt knit courses. In a particularly preferred embodiment of the invention, the breast cups 48' are separated one from the other by areas of gathered panels 50'** in which succeeding courses vary between simple knit and welt knit courses, the knitting of courses defining the front upper torso portion differentially shaping the breast cups with respect to the gathered panels.

A shoulder portion 52' is then knit to the upper torso portion 46' to define front and back fabric straps **53*a* and 53*b*, each having an elongated patterned area in which the courses are simple knit with the areas being divided on the blank by an elongated panel area in which succeeding courses vary between simple knit and welt knit courses. The blank 70 is completed by knitting several courses forming a non-raveling edge 64**.

The bodysuit or teddy 40 shown is FIG. 4 is made from blank 70, shown in FIG. 5, by cutting and removing portions of the blank to form a neck opening 56, a pair of arm holes 54', and to define leg openings 45' having a crotch portion 43' located therebetween, as indicated by the cutting lines 66 on FIG. 5. The waste fabric is removed so as to define the front shoulder straps **53*a* and the rear shoulder straps 53*b* which are sewn together along seams 60 to complete the upper portion of the bodysuit or teddy. Front and rear portions of the blank 70 can be attached together along the crotch portion 43, as indicated at 62 in FIG. 4**. The attachment can be a permanent attachment, such as by sewing, or releasable fasteners such as snaps, buttons, hook and pile fasteners and the like can be used to form a teddy garment.

Banding and the like 58 may be added to finish off the bodysuit or teddy 40 at the neck, arm an leg openings 56, 54 and 45, respectively, or the edges may be selvaged or hemmed in a conventional manner. In addition, a supplemental crotch lining (not shown) can be attached in a conventional manner, where desired.

The shirt, bodysuit and teddy blanks disclosed herein can thus be manufactured rapidly on high speed circular knitting machines and such garments can be manufactured from these blanks utilizing only a minimal number of seams. The shirt, bodysuit and teddy disclosed hereinabove can be used as either an outer or undergarment, depending on the materials used to manufacture the shirt and the wearer's desires, and can be used by women, men and children alike.

In the drawings and specification there has been set forth a preferred embodiment of the invention, and although specific terms are employed, they are used in a generic and descriptive sense only and not for purposes of limitation, the scope of the invention being defined in the claims.

What is claimed is:

1. A method of making a circular knit blank for the manufacture of a garment for covering substantially the entire torso of a wearer comprising:

knitting a series of courses defining a non-raveling edge; and then knitting to the non-raveling edge a series of courses defining a tubular fabric lower torso portion; and then knitting to said lower torso portion a series of courses defining a tubular fabric middle torso portion having a first predetermined cross-stretch; and then knitting to said middle torso portion a series of courses defining a tubular fabric upper torso portion having a second predetermined cross-stretch, a front portion of said upper torso portion having a pair of differentially shaped breast cups with respect to the remainder of the upper torso portion defined by areas in which the courses are simple knit courses; and then knitting to said upper torso portion a series of courses defining a shoulder portion including a plurality of elongated areas in which the courses are simple knit, with the areas being separated from each other by an elongate panel area, and then completing the blank by knitting several courses forming a non-raveling edge.

2. The method of making a circular knit blank for the manufacture of a garment according to claim 1, wherein said steps of knitting series of courses defining a tubular fabric upper torso portion and a tubular fabric middle torso portion comprise knitting said series of courses so that said first predetermined cross-stretch is less than said second predetermined cross-stretch, thereby providing a middle torso portion which is more compressive than said upper torso portion.

3. The method of making a circular knit blank for the manufacture of a garment according to claim 1, wherein said series of courses defining said upper torso portion comprises larger knit stitches than said series of courses defining said middle torso portion.

4. The method of making a circular knit blank for the manufacture of a garment according to claim 1, wherein said step of knitting a series of courses defining a tubular fabric upper torso portion having a pair of differentially shaped breast cups includes knitting an area between the breast cups separating the cups one from another by a gathered panel comprising succeeding courses which vary between simple knit and welt knit courses.

5. The method of making a circular knit blank for the manufacture of a garment according to claim 1, wherein said step of knitting a series of courses defining a tubular fabric lower torso portion includes knitting a portion of the lower torso portion using a pile forming stitch, to thereby form a crotch portion for the garment.

6. The method of making a circular knit blank for the manufacture of a garment according to claim 1, wherein said steps of knitting series of courses defining a tubular fabric upper torso portion and a tubular fabric middle torso portion comprise knitting said series of courses so that said first predetermined cross-stretch is less than said second predetermined cross-stretch, thereby providing a middle torso portion which is more compressive than said upper torso portion, and wherein said step of knitting a series of courses defining a tubular fabric upper torso portion having a pair of differentially shaped breast cups includes knitting an area between the breast cups separating the cups one from another by a gathered panel comprising succeeding courses which vary between simple knit and welt knit courses.

7. The method of making a circularly knit blank for the manufacture of a garment according to claim 1, wherein said step of knitting to said middle torso portion a series of courses defining a tubular fabric upper torso portion occurs at a region of the blank for corresponding to the junction of the wearer's breasts with the torso when the blank is converted into a garment.

8. A circular knit blank for the manufacture of a garment for covering substantially the entire torso of a wearer comprising:

a series of courses defining a non-raveling edge;

a lower torso portion comprising a series of courses knit to said non-raveling edge to define a tubular fabric portion;

a middle torso portion comprising a series of courses knit to said lower torso portion and defining a tubular fabric portion having a first predetermined cross-stretch;

an upper torso portion comprising a series of courses knit to said middle torso portion and defining a tubular fabric portion having a pair of breast cups on a frontal portion thereof defined by areas in which the courses are simple knit, said upper torso portion having a second predetermined cross-stretch;

a shoulder portion comprising a series of courses knit to said upper torso portion and defining plural elongated areas in which the courses are simple knit and each of which is separated from the other by an elongate panel area; and a plurality of courses knit to said shoulder portion and forming a non-raveling edge.

9. The circular knit blank for the manufacture of a garment according to claim 8, wherein said breast cups are separated from each other by gathered panels comprising alternating simple and welt knit courses.

10. The circular knit blank for the manufacture of a garment according to claim 8, wherein said first predetermined cross-stretch is less than said second predetermined cross-stretch, thereby providing a middle torso portion which is more compressive than said upper torso portion.

11. The circular knit blank for the manufacture of a garment according to claim 10, wherein said series of courses defining said upper torso portion comprises larger knit stitches than said series of courses defining said middle torso portion.

12. The circular knit blank for the manufacture of a garment according to claim 8, wherein a portion of said lower torso portion has a pile-forming knit configuration.

13. The circular knit blank for the manufacture of a garment according to claim 8, wherein said breast cups are separated from each other by gathered panels comprising alternating simple and welt knit courses and wherein said first predetermined cross-stretch is less than said second predetermined cross-stretch, thereby providing a middle torso portion which is more compressive than said upper torso portion.

14. A method of making a garment for covering substantially the entire torso of a wearer using a circularly knit blank comprising the steps of:

knitting a series of courses defining a non-raveling edge, then knitting to the non-raveling edge a series of courses defining a tubular fabric lower torso portion; then knitting to the lower torso portion a series of courses defining a tubular fabric middle torso portion having a first predetermined cross-stretch; then knitting to the middle torso portion a series of courses defining a tubular fabric upper torso portion having a second predetermined cross-stretch and a front portion of the upper torso portion having a pair of breast cups defined by two areas in which the courses are simple knit with the areas being separated one from another, then knitting to said upper torso portion a tubular fabric shoulder portion having a plurality of elongated areas in which the courses are simple knit, each of said elongated areas being separated from the others by elongated panel areas; then cutting and removing from the tubular blank areas of the upper torso and shoulder portions to define arm openings and a neck opening, and cutting and removing from the tubular blank areas of the lower torso portion to define first and second leg openings and front and rear crotch portions therebetween, and sewing together front and rear portions of the shoulder portion of the tubular knit blank at opposite sides of said neck opening and attaching front and rear crotch portions together, to thereby form a completed garment.

15. The method of making a garment using a circularly knit blank according to claim 14, further comprising the step of sewing banding around the arm openings and leg openings.

16. The method of making a garment using a circularly knit blank according to claim 14, further comprising the step of sewing banding around the neck opening.

17. The method of making a garment using a circularly knit blank according to claim 14, wherein said step of attaching front and rear crotch portions together comprises securing mating releasable fasteners to the front and rear crotch portions of the lower torso portion, to thereby provide a garment in the form of a teddy.

18. The method of making a garment using a circularly knit blank according to claim 14, wherein said steps of knitting series of courses defining a tubular fabric upper torso portion and a tubular fabric middle torso portion comprise knitting said series of courses so that said first predetermined cross-stretch is less than said second predetermined cross-stretch, thereby providing a middle torso portion which is more compressive than said upper torso portion.

19. A garment made from a circular knit tubular fabric and for covering substantially the entire torso of a wearer comprising:

a tubular fabric lower torso portion including first and second leg openings, with front and rear portions of said lower torso portion being attached together along a crotch portion located between said leg openings;

a middle torso portion integrally knit to the lower torso portion in the form of a tubular fabric portion having a first predetermined cross-stretch;

an upper torso portion having a second predetermined cross-stretch knit to the middle torso portion and having a pair of breast cups defined by two areas in which the fabric is in plain knit courses with the areas in which the fabric is in plain knit courses with the areas being separated one from another, and first and second arm openings located on opposite sides of said breast cups, and a shoulder portion knit to the upper torso portion and including first and second spaced seams connecting front portions of said shoulder portion to rear portions of said shoulder portion and defining a neck opening therebetween.

20. A garment according to claim 19, wherein front and rear portions of said lower torso portion are releasably attached together along the crotch portion located between said leg openings, thereby forming a teddy.

21. A garment according to claim 19, wherein front and rear portions of said lower torso portion are permanently attached together along the crotch portion located between said leg openings, thereby forming a bodysuit.

22. A garment according to claim 19, wherein said first predetermined cross-stretch is less than said second predetermined cross-stretch, thereby forming a middle torso portion which is more compressive than said upper torso portion.

23. A garment according to claim 19, further comprising a gathered central panel located between said breast cups, said central panel including succeeding courses which vary between plain knit and welt knit courses.

24. The shirt made of circularly knit fabric according to claim 19, further comprising banding secured around the arm openings, neck opening and leg openings.

25. A method of making a circularly knit blank for the manufacture of a shirt comprising:

knitting a series of courses defining a tubular fabric torso encircling portion in the form of a first non-raveling edge; and then knitting to said non-raveling edge a series of courses defining a tubular fabric middle torso portion for corresponding to a region of a wearer's body substantially immediately below the breast region, said middle torso portion having a first predetermined cross-stretch; and then knitting to said middle torso portion a series of courses defining a tubular fabric upper torso portion having a second predetermined cross-stretch which is greater than said first predetermined cross-stretch to thereby form a middle torso portion providing greater compression than the upper torso portion; and then knitting to said upper portion a series of courses defining a shoulder portion, then completing the blank by knitting a series of courses defining a tubular fabric portion in the form of a second non-raveling edge.

26. The method of making a blank according to claim 25, wherein said step of knitting a series of courses defining a first non-raveling edge comprises knitting a series of courses defining a cylindrical tubular fabric portion in the form of a turned welt.

27. The method of making a blank according to claim 25, wherein said step of knitting a series of courses defining said upper torso portion comprises knitting stitches which are larger than stitches used to form said series of courses defining said middle torso portion, to thereby form the middle torso portion providing greater compression than the upper torso portion.

28. The method of making a circularly knit blank according to claim 25, wherein said step of knitting a series of courses defining a tubular fabric upper torso portion includes knitting said series of courses to define a pair of differentially shaped breast cups on a front portion of the upper torso portion.

29. The method of making a circularly knit blank for the manufacture of a garment according to claim 28, wherein said step of knitting a series of courses defining a tubular fabric upper torso portion having a pair of differentially shaped breast cups includes knitting an area between the breast cups separating the cups one from another by a gathered panel comprising succeeding courses which vary between simple knit and welt knit courses.

30. A circularly knit blank for making a shirt having a minimal number of pieces and seams comprising:

a plurality of courses forming a first non-raveling edge;

a middle torso portion for corresponding to a region of a wearer's body substantially immediately below the breast region defined by a series of courses knitted to said first non-raveling edge and forming a tubular fabric portion having a first predetermined cross-stretch;

an upper torso portion defined by a series of courses knitted to said middle torso portion and forming a tubular fabric portion having a second predetermined cross-stretch which is greater than said first predetermined cross-stretch to form a middle torso portion which provides a greater amount of compression than said upper torso portion;

a shoulder portion knitted to said upper torso portion and including a series of courses defining plural elongated areas in which the courses are simple knit and each of which is separated from the other by an elongate panel area; and a series of courses knit to said shoulder portion and defining a second non-raveling edge.

31. The circularly knit blank according to claim 30, further comprising a pair of breast cups located on a front portion of said upper torso portion, said breast cups being defined by areas in which the courses are simple knit.

32. The circularly knit blank according to claim 30, wherein said breast cups are separated from each other by gathered panels comprising alternating simple and welt knit courses.

33. The circular knit blank according to claim 30, wherein said series of courses defining said upper torso portion comprises larger knit stitches than said series of courses defining said middle torso portion.

34. The circular knit blank according to claim 30, wherein said plurality of courses forming a first non-raveling edge comprise a cylindrical tubular fabric portion in the form of a turned welt.

35. A method of making a shirt having a minimal number of pieces and seams from a circularly knit blank comprising:

knitting a series of courses defining a tubular fabric torso encircling portion in the form of a first non-raveling edge; and then knitting to said non-raveling edge a series of courses defining a tubular fabric middle torso portion for corresponding to a region of a wearer's body substantially immediately below the breast region, said middle torso portion having a first predetermined cross-stretch; and then knitting to said middle torso portion a series of courses defining a tubular fabric upper torso portion having a second predetermined cross-stretch which is greater than said first predetermined cross-stretch to thereby form a middle torso portion providing greater compression than the upper torso portion; and then knitting to said upper portion a series of courses defining a shoulder portion, then knitting a series of courses defining a tubular fabric portion in the form of a second non-raveling edge, then cutting and removing from the tubular blank areas of the upper torso and shoulder portions to define arm openings and a neck opening, and attaching together front and rear portions of the shoulder portion of the tubular blank at opposite sides of said neck opening to form a completed shirt.

36. The method of making a shirt according to claim 35, wherein said step of knitting a series of courses defining a first non-raveling edge comprises knitting a series of courses defining a cylindrical tubular fabric portion in the form of a turned welt.

37. The method of making a shirt according to claim 35, wherein said step of knitting a series of courses defining said upper torso portion comprises knitting stitches which are larger than stitches used to form said series of courses defining said middle torso portion, to thereby form the middle torso portion providing greater compression than the upper torso portion.

38. The method of making a shirt according to claim 35, wherein said step of knitting a series of courses defining a tubular fabric upper torso portion includes knitting said series of courses to define a pair of differentially shaped breast cups on a front portion of the upper torso portion.

39. The method of making a shirt according to claim 38, wherein said step of knitting a series of courses defining a tubular fabric upper torso portion having a pair of differentially shaped breast cups includes knitting an area between the breast cups separating the cups one from another by a gathered panel comprising succeeding courses which vary between simple knit and welt knit courses.

40. The method of making a shirt according to claim 35, further comprising the step of sewing banding around the arm openings.

41. The method of making a shirt according to claim 35, further comprising the step of sewing banding around the neck opening.

42. A shirt made from a circularly knit tubular fabric blank comprising:

a tubular fabric torso encircling portion in the form of a non-raveling edge;

a middle torso portion defined by a series of courses knitted to said non-raveling edge and forming a tubular fabric portion having a first predetermined cross-stretch;

an upper torso portion for corresponding to region of a wearer's body substantially immediately below the breast region defined by a series of courses knitted to said middle torso portion and forming a tubular fabric portion having a second predetermined cross-stretch which is greater than said first predetermined cross-stretch to form a middle torso portion which provides a greater amount of compression than said upper torso portion;

a shoulder portion knitted to said upper torso portion and including first and second spaced seams connecting front portions of said shoulder portion to rear portions of said shoulder portion and defining a neck opening therebetween.

43. The shirt according to claim 42, further comprising a pair of breast cups located on a front portion of said upper torso portion, said breast cups being defined by areas in which the courses are simple knit.

44. The shirt according to claim 42, wherein said breast cups are separated from each other by gathered panels comprising alternating simple and welt knit courses.

45. The shirt according to claim 42, wherein said series of courses defining said upper torso portion comprises larger knit stitches than said series of courses defining said middle torso portion.

46. The shirt according to claim 42, wherein the tubular fabric torso encircling portion comprises a cylindrical tubular fabric portion in the form of a turned welt.

47. The shirt according to claim 42, wherein the middle torso portion joins the upper torso portion at a position corresponding to the junction of a wearer's breasts with the torso.

* * * * *